United States Patent [19]

Fastert

[11] Patent Number: 4,716,955

[45] Date of Patent: Jan. 5, 1988

[54] CONTINUOUS CASTING METHOD

[75] Inventor: Herbert P. Fastert, Franklin Lakes, N.J.

[73] Assignee: SMS Concast Inc., Montvale, N.J.

[21] Appl. No.: 872,956

[22] Filed: Jun. 11, 1986

[51] Int. Cl.[4] ..... B22D 11/00

[52] U.S. Cl. ..... 164/475; 164/418; 164/476

[58] Field of Search ..... 164/418, 459, 475, 476

[56] References Cited

U.S. PATENT DOCUMENTS

| | | | |
|---|---|---|---|
| 2,131,307 | 9/1938 | Behrendt | 164/418 |
| 2,824,346 | 2/1958 | Osborn | 164/472 |
| 3,512,573 | 5/1970 | Herff | 164/485 |
| 3,612,149 | 10/1971 | Rossi | 164/490 |
| 3,908,735 | 9/1975 | Di Candia | 164/475 |
| 3,910,342 | 10/1975 | Johnson | 164/418 |
| 4,635,702 | 1/1987 | Kolakowski et al. | 164/418 |

FOREIGN PATENT DOCUMENTS

| | | | |
|---|---|---|---|
| 0149734 | 7/1985 | European Pat. Off. . | |
| 2518903 | 1/1976 | Fed. Rep. of Germany . | |
| 3400220 | 7/1985 | Fed. Rep. of Germany | 164/418 |
| 1566597 | 9/1969 | France . | |
| 58-77752 | 5/1983 | Japan . | |
| 363129 | 8/1962 | Switzerland . | |
| 2109721 | 6/1983 | United Kingdom | 164/418 |

OTHER PUBLICATIONS

Jacobi, Hatto, "Arch. Eisenhuttenwesen", 47, No. 7, pp. 441–446 (1976).

Chizhikov et al, "Stal in English", Oct. 1970, pp. 785–786.

Martynov et al, "Stal in English", Oct. 1970, p. 782.

*Primary Examiner*—Nicholas P. Godici

*Assistant Examiner*—Richard K. Seidel

*Attorney, Agent, or Firm*—Peter K. Kontler; Tobias Lewenstein

[57] ABSTRACT

A mold for the continuous casting of metal to a sheet-like strand is provided with a casting passage having a slot-shaped outlet end. The inlet end of the casting passage is considerably wider, and has a much larger area, than the outlet end. This facilitates pouring of molten metal into the mold and permits the use of casting techniques such as shrouding which enhance the continuous casting process and/or the quality of the strand. The cross-sectional area of the casting passage decreases progressively from the area at the inlet end to that at the outlet end over at least a portion of the length of the mold. The perimeter of the casting passage, however, remains at least approximately constant as the area decreases. This enables the strand to be drawn through the mold without difficulty. A continuous casting method involves pouring molten metal into a casting passage, and partially solidifying the molten metal to form a strand which is drawn through the casting passage. The cross-sectional area of the strand is reduced between upstream and downstream locations of the casting passage while maintaining the perimeter of the strand at least approximately constant. The reduction in cross-sectional area is carried out in such a manner that the strand has a sheet-like configuration upon exiting the casting passage.

20 Claims, 10 Drawing Figures

CONTINUOUS CASTING METHOD

BACKGROUND OF THE INVENTION

The invention relates generally to continuous casting. More particularly, the invention relates to a mold for the continuous casting of metals, e.g., steel, and to a continuous casting method.

Steel sheet made from continuously cast steel is currently produced from a continuously cast slab having a thickness in the range of about eight to twelve inches. The slab is cut into sections as it emerges from the continuous casting machine, and the sections are reheated and passed through a roughing train to produce sheet bar. The sheet bar is hot rolled and then processed further for direct use or cold rolling.

It has long been recognized that reheating of the slab sections for roughing consumes considerable amounts of energy while the roughing equipment constitutes a large capital expenditure as well as a source of substantial maintenance costs. Accordingly, many attempts have been made to continuously cast steel to a gage corresponding to that of sheet bar.

Continuous casting of steel to the gage of sheet bar poses many problems. To begin with, sheet bar generally has a thickness of one to two inches. If a continuous casting mold is designed so that the inlet opening of the casting passage has a thickness corresponding to the thickness of sheet bar, the opening is quite narrow and it is extremely difficult to aim the casting stream into the mold. Furthermore, sheet bar has a relatively great width of twenty to one hundred inches which means that the width of the casting passage must be of this order. When the thickness of the casting passage is small, there then arises the problem of distributing the molten steel entering the mold over the width of the casting passage. Thus, if the casting stream is directed into the center of the mold in accordance with current casting practice, the steel tends to solidify before reaching the edges of the casting passage. An additional difficulty arises when casting high grade steels. In order to protect such steels from atmospheric contamination, it is the practice to teem the steel into the mold via a ceramic shroud or tube which bridges the gap between the mold and the tundish. The shroud must have a certain diameter, and the portion of the shroud which is immersed in the mold must have a clearance of at least one-half inch on all sides. Therefore, if the inlet opening of the casting passage has a thickness corresponding to the gage of sheet bar, it is not possible to employ a shroud.

The preceding problems have been alleviated to a degree by designing the inlet opening of the casting passage with a central portion wide enough to receive a pouring shroud. On either side of the central portion is a lateral portion having a thickness equal to the desired final gage, and the central portion narrows in a direction towards each of the lateral portions. The central portion also narrows in a direction from the inlet end to the outlet end of the casting passage so that the outlet opening has a uniform thickness corresponding to the desired gage.

While the problems involved in introducing molten steel into the mold have been reduced by widening the central portion of the inlet opening, there are considerable problems in withdrawing the continuously cast strand from the mold. These withdrawal problems have prevented successful continuous casting of steel to the gage of sheet bar.

OBJECTS AND SUMMARY OF THE INVENTION

It is an object of the invention to provide a continuous casting mold which is capable of successfully producing strands having the gage of sheet bar.

Another object of the invention is to provide a continuous casting mold which makes it possible to continuously cast metals, including steel, to the gage of sheet bar using conventional casting techniques such as shrouding.

An additional object of the invention is to provide a method which makes possible successful continuous casting of strands having the gage of sheetbar.

A further object of the invention is to provide a method which allows metals, including steel, to be continuously cast to the gage of sheet bar using conventional casting techniques such as shrouding.

The preceding objects, as well as others which will become apparent as the description proceeds, are achieved by the invention.

A continuous casting mold according to the invention comprises wall means defining a casting passage having an inlet opening for molten metal and an outlet opening for a continuously cast strand. The casting passage includes a section extending from a first location remote from the outlet opening to a second location between the first location and the outlet opening. The first location has a first cross-sectional area, and the second location has a second cross-sectional area smaller than the first cross-sectional area. The perimeter of the casting passage is at least approximately constant throughout the section of the casting passage between the first and second locations, i.e., the perimeter of the casting passage is at least approximately the same in all planes which pass through such section and are perpendicular to the longitudinal axis of the casting passage.

The invention is based on the recognition that the area of an article is reduced with least resistance when the perimeter remains unchanged. By taking this fact of physics into account, the strand withdrawal problems encountered in the molds of the prior art may be reduced or eliminated thereby allowing a strand to be withdrawn with little or no damage and with little or no danger of a breakout. The inlet opening of a mold according to the invention may have any convenient size so that conventional casting techniques such as shrouding may be employed.

A continuous casting method in accordance with the invention comprises the following steps:

A. Continuously admitting a stream of molten metal into a casting passage.

B. Partially solidifying the molten metal in the casting passage to form a continuously cast strand.

C. Continuously drawing the strand through the casting passage.

D. Reducing the cross-sectional area of the strand between upstream and downstream locations of the casting passage.

E. Maintaining the perimeter of the strand at least approximately constant during the reducing step.

The novel features which are considered as characteristic of the invention are set forth in particular in the appended claims. The improved continuous casting mold itself, however, both as to its construction and its mode of operation, together with additional features and advantages thereof, will be best understood from a perusal of the following detailed description of certain specific embodiments when read in conjunction with the accompanying drawings.

DESCRIPTION OF THE PREFERRED EMBODIMENTS

Figure 1:
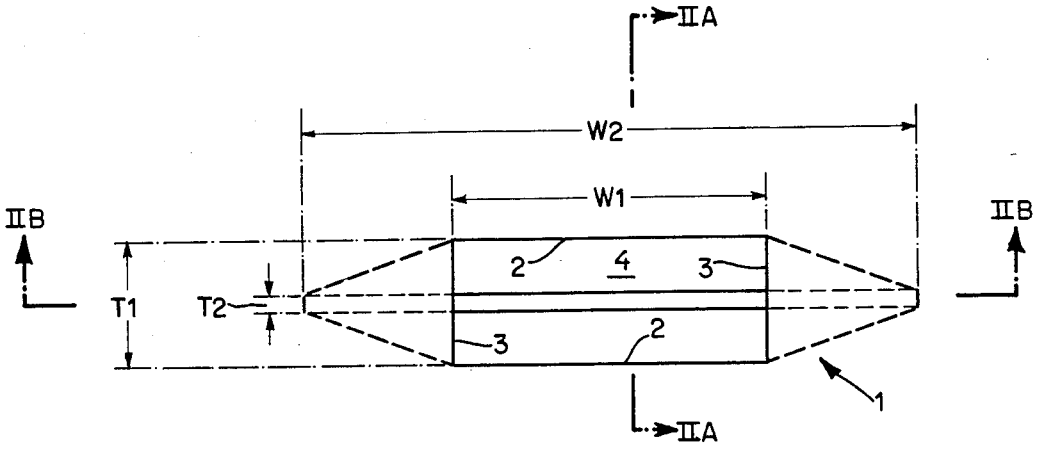
FIG. 1 is a schematic plan view of a continuous casting mold according to the invention with certain portions shown in phantom lines for ease of visualization.
Figure 2A:
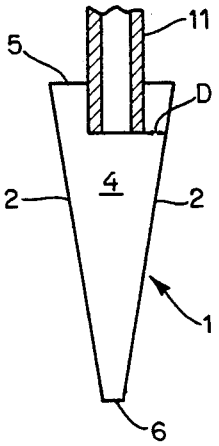
FIG. 2*a* is a schematic sectional view in the direction of the arrows IIA—IIA of FIG. 1 and additionally shows a pouring shroud extending into the mold.
Figure 2B:
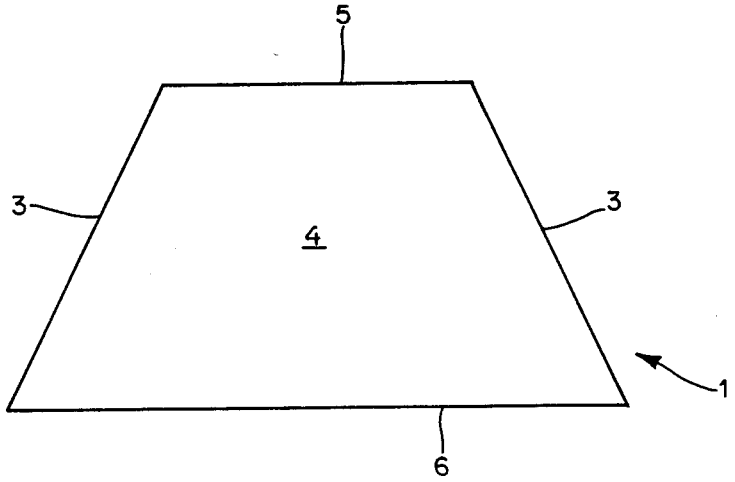
FIG. 2*b* is a schematic sectional view in the direction of the arrows IIB—IIB of FIG. 1.

FIGS. 1, 2*a* and 2*b* illustrate a mold 1 which may be used for the continuous casting of metals, including steel. The mold 1 has a pair of opposed side walls 2 and a pair of opposed end walls 3. The walls 2 and 3, which may be composed of copper or a copper alloy as is usual in molds for the continuous casting of steel, cooperate to define a casting passage 4.

The casting passage 4 has an inlet end 5 which serves for the introduction of molten metal into the mold 1. The casting passage 4 further has an outlet end 6 via which a continuously cast strand may be withdrawn from the mold 1.

At the inlet end 5 of the mold 1, the walls 2,3 define an inlet opening which is here shown as being rectangular. The inlet opening has a width W1 and a thickness T1 and accordingly has an area $A1=W1\times T1$. The dimensions W1 and T1 are sufficiently large that all accessories currently employed to enhance the continuous casting process and/or the quality of the strand may be used with the mold 1, e.g., the dimensions W1 and T1 are large enough to permit insertion of a pouring shroud into the inlet opening.

As shown in FIGS. 2*a* and 2*b*, respectively, the walls 2 continuously converge while the walls 3 continuously diverge from the inlet end 5 to the outlet end 6 of the mold 1. As a result, the width of the casting passage 4 continuously increases whereas the thickness of the casting passage 4 continuously decreases from the inlet end 5 to the outlet end 6. At the outlet end 6, the walls 2,3 define a slot-shaped outlet opening having a width W2 and a thickness T2. The outlet opening has an area $A2=W2\times T2$ which is smaller than the area A1 of the inlet opening.

The cross-sectional area of the casting passage 4 decreases continuously from the area A1 at the inlet opening to the area A2 at the outlet opening. In accordance with the invention, the mold 1 is designed in such a manner that the perimeter of the casting passage 4 remains at least approximately constant from the inlet opening to the outlet opening. Thus, the perimeter of the casting passage 4 is at least approximately the same in all planes normal to the longitudinal axis of the casting passage 4, that is, the axis of the casting passage 4 extending in the casting direction.

The slot-shaped outlet opening of the mold 1 is designed to discharge a sheet-like continuously cast strand having a width W2 and a thickness or gage T2 respectively corresponding to the width and thickness of sheet bar. In spite of the fact that the inlet opening of the casting passage 4 is sufficiently large to permit teeming of molten metal into the mold 1 without difficulty and to permit the use of all conventional casting techniques, the strand may be withdrawn from the mold 1 without problem, i.e., without tearing or compressing the solidified shell. This is due to the fact that the perimeter of the casting passage 4 is maintained at least approximately constant from the inlet opening to the outlet opening so as to conform to the natural mode of deformation of the strand from the configuration of the inlet opening to that of the outlet opening.

FIG. 2*a* illustrates a pouring tube 11 extending into the mold 1 through the inlet end 5. Although the mold 1 is designed to discharge a strand having a thickness T2 far smaller than the diameter of the pouring tube 11, the latter can nevertheless be readily introduced into the mold 1. This is due to the design of the mold 1 by virtue of which the cross-sectional area and thickness of the casting passage 4 in the region of the inlet end 5 are larger than the cross-sectional area and thickness in the region of the outlet end 6.

In operation, the pouring tube 11 will normally extend downwards into the mold 1 for a distance of four to eight inches. For optimum results, the pouring tube 11 should not contact the walls 2,3 of the mold 1 but should be spaced from each of the walls 2,3 by a gap D of at least one-half inch. The mold 1 should thus be designed so that the portion of the casting passage 4 which receives the pouring tube 11 has dimensions sufficiently large to accommodate the pouring tube 11 with the clearance D.

Figure 3:
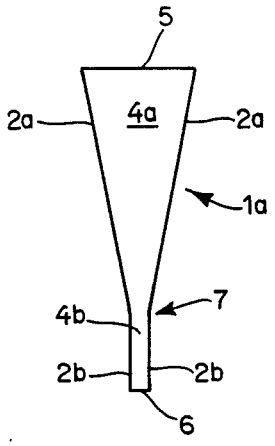
FIG. 3 is similar to FIG. 2*a* but illustrates another embodiment of the mold.

FIG. 3 shows a mold 1*a* which differs from the mold 1 of FIGS. 1, 2*a* and 2*b* in that the casting passage includes an upstream section 4*a* of variable cross-sectional area and a downstream section 4b of constant cross-sectional area. The upstream section 4*a* extends from the inlet end 5 of the mold 1a to a location 7 intermediate the inlet end 5 and the outlet end 6 while the downstream section 4*b* extends from the location 7 to the outlet end 6.

The upstream section 4*a* resembles the casting passage 4 and is laterally bounded by a pair of side walls 2*a* which continuously converge from the inlet end 5 of the mold 1*a* to the location 7. The upstream section 4*a*, which is further bounded by two end walls such as the end walls 3 of the mold 1, has a rectangular inlet opening at the inlet end 5, and the inlet opening again has a width W1 and a thickness T1. At the location 7, the casting passage 4*a*,4*b* has a slot-shaped configuration, and the width of the casting passage 4*a*,4*b* is W2 while its thickness is T2. The cross-sectional area of the upstream section 4*a* decreases continuously from the area $A1=W1\times T1$ at the inlet opening to the area $A2=W2\times T2$ at the location 7. The perimeter of the upstream section 4*a* however, remains at least approximately constant all the way from the inlet opening to the location 7.

The downstream section 4*b* is laterally bounded by a pair of side walls 2*b* which merge smoothly into the respective side walls 2*a* at the location 7. The side walls 2*b* are essentially parallel to one another, as are the non-illustrated end walls which flank the downstream section 4*b* and correspond to the end walls 3 of the mold 1. The downstream section 4*b* thus has a substantially constant width W2 and a substantially constant thickness T2 everywhere between the location 7 and the outlet end 6 of the mold 1*a*.

Figure 4:
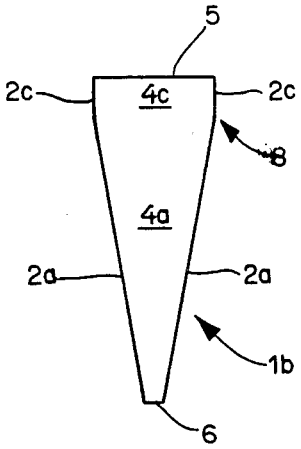
FIG. 4 is similar to FIG. 3 but shows a further embodiment of the mold.

FIG. 4 illustrates a continuous casting mold 1*b* in which the casting passage again includes the section 4*a*. Here, however, the section 4*a* is located downstream of a section 4*c* also constituting part of the casting passage. The mold 1*b*, like the mold 1 and the mold 1*a*, is designed to have a generally vertical orientation in use, that is, the mold 1*b* is designed so that the casting passage 4*c*,4*a* extends generally vertically during casting. When casting into a generally vertical mold, the rate of admission of molten metal and the rate of withdrawal of the strand are regulated in such a manner that molten metal fills the mold to a fairly constant predetermined level which is located below the inlet end and is known as the meniscus level. The upstream section 4*c* of the mold 1*b* extends from the inlet end 5 to a location 8 at or near the meniscus level. The downstream section 4*a* extends from the location 8 to the outlet end 6 of the mold 1*b*.

The upstream section 4*c* of the casting passage 4*c*,4*a* is laterally bounded by a pair of parallel side walls 2*c* which merge smoothly into the respective side walls 2*a* of the downstream section 4*a*. The upstream section 4*c* is further bounded by two parallel, non-illustrated end walls corresponding to the end walls 3 of the mold 1. Hence, the cross-sectional area and shape of the upstream section 4*c* are constant.

The mold 1*b* again has a rectangular inlet opening of width W1 and thickness T1. Since the cross-sectional area and shape of the upstream section 4*c* are constant, the dimensions and shape of the casting passage 4*c*,4*a* at the location 8 are the same as those at the inlet opening. The outlet opening of the mold 1*b* is slot-shaped as before and has a width W2 and thickness T2. The cross-sectional area of the downstream section 4*a* decreases continuously from the area $A1=W1\times T1$ at the location 8 to the area $A2=W2\times T2$ at the outlet opening. The perimeter of the downstream section 4*a* remains at least approximately constant throughout.

Figure 5:
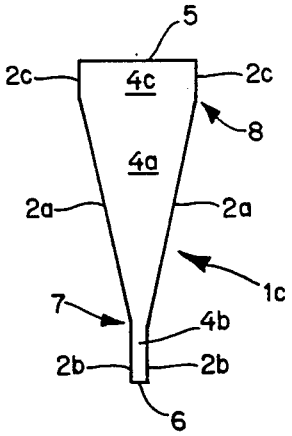
FIG. 5 is similar to FIG. 4 but illustrates an additional embodiment of the mold.

FIG. 5 shows a continuous casting mold 1*c* in which the casting passage is composed of the three sections 4*c*,4*a*,4*b*. Here, the section 4*c* extends from the inlet end 5 to the location 8 as in the mold 1*b* while the section 4*b*-extends from the location 7 to the outlet end 6 as in the mold 1*a*. The section 4*a* extends between the locations 8 and 7.

The mold 1*c* has a rectangular inlet opening of width W1 and thickness T1, and a slot-shaped outlet opening of width W2 and thickness T2. Due to the configuration of the upstream section 4*c*, the casting passage 4*c*,4*a*,4*b* is rectangular with an area $A1=W1\times T1$ at the location 8. Similarly, the casting passage 4*c*,4*a*,4*b* is slot-shaped with an area $A2=W2\times T2$ at the location 7. The cross-sectional area of the casting passage 4*c*,4*a*,4*b* decreases progressively from the location 8 to the location 7 while its perimeter remains at least approximately constant.

In operation of the molds 1–1*c*, molten metal, e.g., steel, is continuously teemed into the inlet end 5. The walls of the molds 1–1*c* are cooled as usual so that the molten metal adjacent to the walls solidifies to form a thin shell constituting the skin of a continously cast strand. The molten metal farther away from the walls remains in the molten state and constitutes a molten core of the strand. The strand is drawn through the casting passage and the outlet end 6 by exerting a pull on the skin of the strand via a conventional withdrawal unit. As the strand moves through the casting passage, the thickness of the skin increases progressively due to progressive solidification of the molten core. The rate of admission of molten metal into, and the rate of withdrawal of the strand from, the casting passage are regulated in such a manner that the pool of molten metal in the casting passage remains at a fairly constant predetermined level, namely, the meniscus level.

The cross-sectional area of the strand is progressively reduced as the strand is drawn through the casting passage while, at the same time, the perimeter of the strand is maintained at least approximately constant. In each of the molds 1–1*c*, the reduction in the cross-sectional area of the strand is initiated in the region of the meniscus level. The progressive reduction in cross-sectional area continues all the way to the outlet end 6 in each of the molds 1 and 1*b* whereas the reduction in cross-sectional area terminates at the location 7 in the molds 1*a* and 1*c*. In all cases, however, the strand has a sheet-like configuration upon exiting the mold.

The molds 1–1*c* may be designed such that the respective casting passages have rectangular cross sections throughout. However, the invention is not limited to such a design. The inlet openings as well as other locations of the casting passages upstream of the respective outlet openings may have any polygonal, arcuate or other configuration which is capable of being progressively converted to the slot-shaped outline of the outlet openings.

Figure 6:
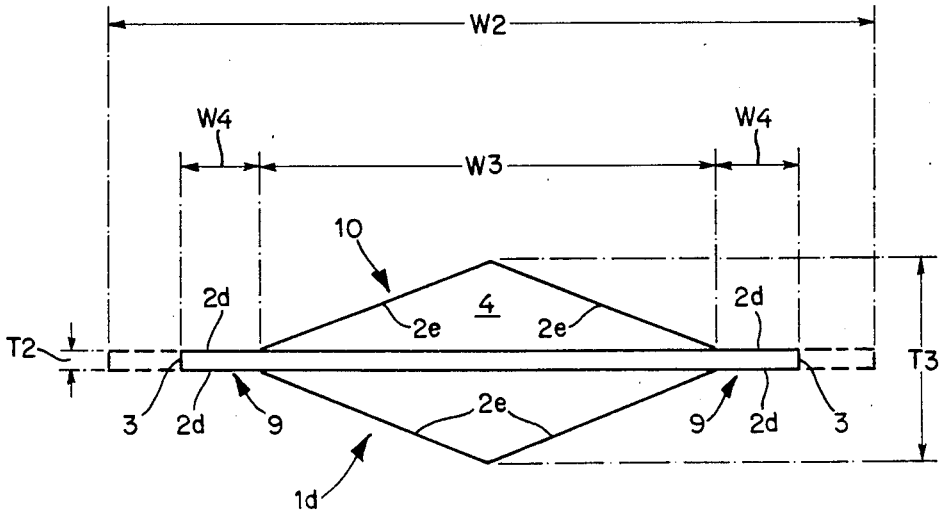
FIG. 6 is similar to FIG. 1 but shows yet another embodiment of the mold.

FIG. 6 illustrates a continuous casting mold 1*d* in which the casting passage 4 again has a slot-shaped outlet opening of width W2 and thickness T2. However, unlike the molds 1–1*c* of FIGS. 1–5, the inlet opening of the casting passage 4 in FIG. 6 does not have a single thickness. Rather, the inlet opening in FIG. 6 includes a central or first portion 10 of variable thickness, and a lateral or second portion 9 of constant thickness disposed on either side of the central portion 10.

The central portion 10 of the inlet opening is defined by four side wall segments 2*e* which are arranged such that the central portion 10 is diamond-shaped. However, the configuration of the central portion 10 is of secondary importance and the central portion 10 may assume various other configurations. For example, the central portion 10 may have any polygonal outline, including a square outline, a rectangular outline, an hexagonal outline, and so on.

A primary consideration for the central portion 10 is that this be sufficiently large to permit teeming of molten metal into the mold 1*d* without difficulty and to permit the use of all accessories currently employed to enhance the continuous casting process and/or the quality of the strand. The width W3 and maximum thickness T3 of the central portion 10 are selected accordingly.

Each of the lateral portions 9 of the inlet opening is bounded by a pair of parallel side wall segments 2*d* and an end wall 3. The lateral portions 9 have the same thickness T2 as the slot-shaped outlet opening, and the thickness T2 is considerably smaller than the maximum thickness T3 of the central portion 10. Thus, the central portion 10 narrows in the directions from its region of maximum thickness towards the respective lateral portions 9, and each of the side wall segments 2e is inclined with reference to, and merges into, a respective side wall segment 2d.

The inlet opening 10,9 of the mold 1d has an area $A3=W3/2\times(T3-T2)+W3\times T2+2W4\times T2$. The area A3 significantly exceeds the area A2 of the slot-shaped outlet opening, and the cross-sectional area of the casting passage 4 of the mold 1d progressively decreases from A3 to A2 while the perimeter of the casting passage 4 remains at least approximately constant.

Figure 7:
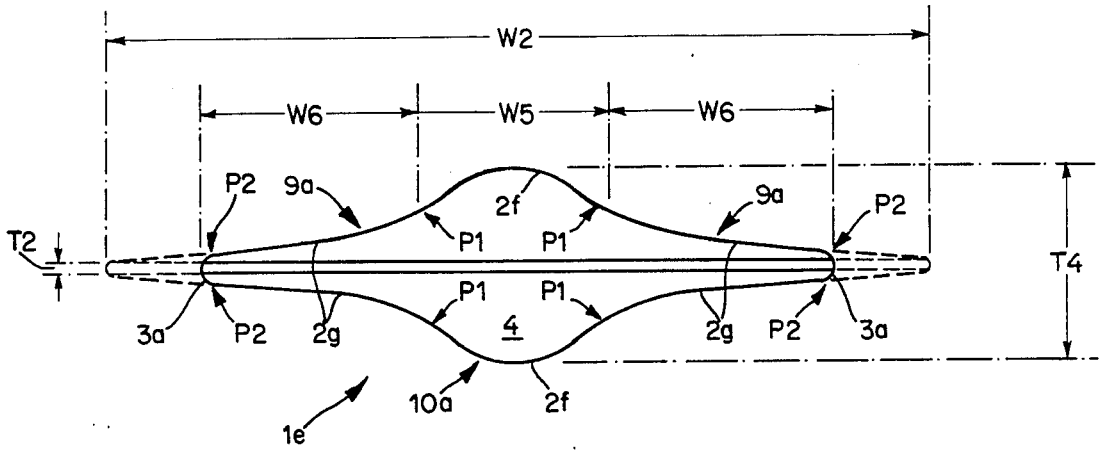
FIG. 7 is similar to FIG. 1 but illustrates one more embodiment of the mold.

In the mold 1d, the inlet opening is polygonal, and the polygonal outline of the central portion 10 of the inlet opening is gradually converted into the slot-shaped outline of the central portion of the outlet opening. FIG. 7 illustrates a mold 1e which, in contrast to the mold 1d, has an inlet opening of arcuate configuration.

The inlet opening of the mold 1e of FIG. 7 has a central or first portion 10a of variable thickness which is flanked on either side by a lateral or second portion 9a of variable thickness. The central portion 10a is bounded by a pair of arcuate wall segments 2f which are concave with respect to the casting passage 4. Each of the lateral portions 9a, on the other hand, is bounded by a pair of arcuate wall segments 2g which are convex with respect to the casting passage 4, and an arcuate end wall 3a which is concave with respect to the casting passage 4. The wall segments 2f merge smoothly into the adjacent wall segments 2g at the respective points of inflection P1 while the wall segments 2g merge smoothly into the corresponding end walls 3a at the respective points of inflection P2.

The wall segments 2f are here generally elliptical so that the central portion 10a has an elliptical configuration. However, the wall segments 2f could just as well be circular thereby imparting a circular configuration to the central portion 10a.

The central portion 10a has a width W5 and a maximum thickness T4 while each of the lateral portions 9a has a width W6 and a thickness which is everywhere smaller than the maximum thickness T4 of the central portion 10a. The width W5 and maximum thickness T4 of the central portion 10a are selected in such a manner that the central portion 10a is sufficiently large to permit convenient teeming of molten metal into the casting passage 4 and to permit the use of all accessories currently employed to enhance the continuous casting process and/or the quality of the strand. The thickness of the central portion 10a decreases continuously from the region of maximum thickness T4 to the respective lateral portions 9a. The thickness of each lateral portion 9a likewise decreases continuously from its junction with the central portion 10a to the respective end wall 3a.

The outlet opening of the mold 1e is slot-shaped as before with a width W2 and a thickness T2. In the illustrated embodiment, the minimum thickness of the lateral portions 9a of the inlet opening exceeds the thickness T2 of the outlet opening. However, the minimum thickness of the lateral portions 9a may also equal the thickness T2. The area of the inlet opening is significantly larger than that of the outlet opening, and the cross-sectional area of the casting passage 4 decreases continuously from the area of the inlet opening to the area of the outlet opening while the perimeter of the casting passage 4 remains at least approximately constant. The decrease in cross-sectional area is accompanied by a gradual change from the arcuate configuration of the inlet opening to the rectangular configuration of the outlet opening.

The configurations of the central portion 10 of FIG. 6 and the central portion 10a of FIG. 7 are not restricted to those mentioned. The walls 2e of the central portion 10 and the walls 2f of the central portion 10a may be designed according to any polynomial expression.

The molds 1–1e are designed to discharge a sheet-like strand having a thickness corresponding to that of sheet bar thereby making it possible to eliminate the roughing operation which is normally required in order to convert a continuously cast slab into sheet. The invention may similarly be used to eliminate the usual roughing operation undergone by the webs of continuously cast beam blanks and other structural shapes, e.g., C-shapes.

Figure 8:
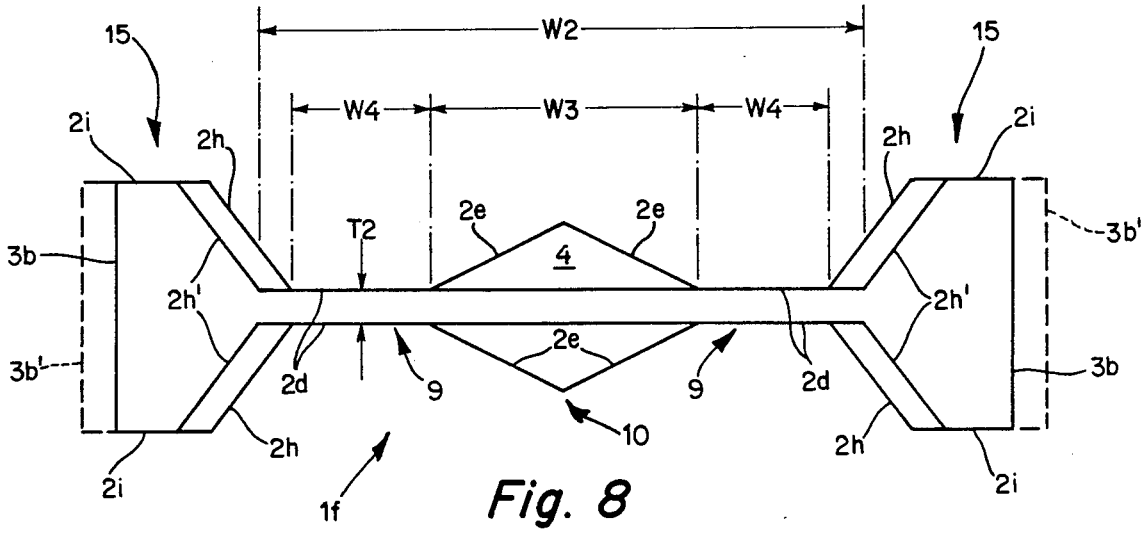
FIG. 8 is similar to FIG. 1 but shows still a further embodiment of the mold.

FIG. 8 shows a beam blank mold 1f which, in accordance with the invention, is designed to discharge a beam blank having a web of width W2 and thickness T2. The thickness T2 corresponds to the web thickness of a beam blank or other structural shape which has been continuously cast in a conventional beam blank mold and roughed. The thickness T2 is accordingly too small to permit convenient teeming of molten metal into the mold 1f or to permit use of the accessories currently employed to enhance the continuous casting process and/or the quality of the strand.

In order to facilitate the admission of molten metal into the mold 1f and to permit the use of such accessories, the section of the inlet opening corresponding to the web of the beam blank is designed in the same manner as the inlet opening of the mold 1d of FIG. 6. Thus, the section of the inlet opening of the mold 1f corresponding to the web of the beam blank has an enlarged central portion 10 which is flanked on either side by a lateral portion 9 of thickness T2. The inlet opening of the mold 1f further has two sections 15 each of which is adjacent to one of the lateral portions 9 and is located on that side of the respective lateral portion 9 remote from the central portion 10. The sections 15 correspond to the flanges of the beam blank.

Each of the sections 15 is bounded by a pair of walls 2h which extend from and are inclined with reference to the respective walls 2d of the adjacent lateral portion 9, and a pair of walls 2i which extend from the respective walls 2h and are parallel to the walls 2d. The walls 2i of each section 15 are joined by an end wall 3b.

The area of the web section of the inlet opening significantly exceeds that of the web section of the outlet opening, and the cross-sectional area of the web section of the casting passage 4 decreases continuously from the area of the inlet opening to the area of the outlet opening. The perimeter of the web section of the casting passage 4, however, remains at least approximately constant as the area decreases. The decrease in cross-sectional area of the web section of the casting passage 4 is accompanied by an increase in the width of the web section, and this increase is given by $W2-(W3+2W4)$. The width increase is symmetrical about the central portion 10 so that, at the outlet opening, each of the flange sections 15 of the inlet opening has been shifted to the outside by a distance $\frac{1}{2}[W2-(3+W4)]$. It is assumed here that, except for any taper which may be present to compensate for shrinkage of the strand as the latter travels through the mold 1f, the cross-sectional areas of the flange sections remain essentially unchanged between the inlet and outlet openings. The reference characters 2h'denote the shifted positions of the inclined walls 2h of the flange sections 15 while the reference characters 3b' denote the shifted positions of the end walls 3b of the flange sections 15.

A continuous casting mold is normally cooled over the entire length between the meniscus and the outlet end of the mold. As a result, a thin shell of solidified metal forms adjacent to the walls of the mold at a short distance below the meniscus, and the thickness of the shell increases progressively with increasing distance from the meniscus. The increasing thickness of the shell combined with the accompanying temperature drop causes the strength of the shell to increase rapidly.

In a mold according to the invention, the increasing strength of the shell with increasing distance from the meniscus progressively increases the resistance of the shell to the deformation necessary to reduce the cross-sectional area of the strand. This increases the force which is required to draw the strand through the mold. The increased force not only increases mold friction and wear but also increases the stress in the shell which, in turn, may adversely affect the quality of the strand.

The invention provides a means for limiting the increase in strength of the shell while the cross-sectional area of the strand is being reduced. This involves the introduction of a pressurized fluid having relatively low thermal conductivity between the shell and the walls of the mold while maintaining the mold cooling as usual. The pressurized fluid may be a gas, or a liquid which vaporizes upon being admitted into the region between the shell and the walls of the mold. Preferred fluids are the heavier noble gases, that is, the noble gases heavier than helium, and particularly argon.

Figure 9:
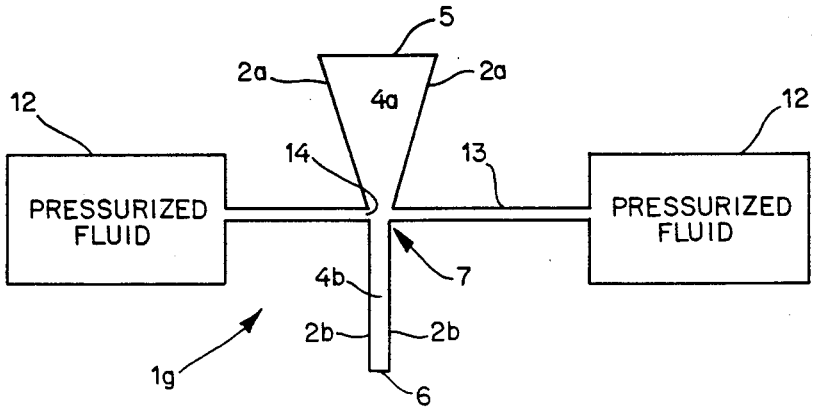
FIG. 9 is similar to FIG. 2*a* but illustrates an additional embodiment of the mold.

FIG. 9 illustrates a mold 1g which allows the strength of the shell to be kept relatively low during reduction of the cross-sectional area of the strand. The mold 1g resembles the mold 1a of FIG. 3 but differs from the latter in certain respects. To begin with, the rate of change of the cross-sectional area in the upstream section 4a is greater in the mold lg of FIG. 9 than in the mold 1a of FIG. 3. This is possible because the strength of the shell in the mold 1g may be kept below the strength of the shell in the mold 1a. Furthermore, as may be seen from a comparison of FIGS. 3 and 9, the length of the upstream section 4a relative to the downstream section 4b is smaller in the mold 1g than in the mold 1a. In addition, the mold 1g is provided with one or more apertures 14 in the region of the junction between the upstream and downstream sections 4a,4b. The apertures 14 serve for the introduction of a pressurized fluid into the casting passage 4a,4b.

In operation, the apertures 14 are connected with conduits 13 leading to one or more sources 12 of a pressurized fluid such as argon. Molten metal is teemed into the casting passage 4a,4b via the inlet end 5 of the mold lg while the latter is cooled in a conventional manner. Simultaneously, the pressurized fluid from the source or sources 12 is admitted into the casting passage 4a,4b. The conduits 13 are equipped with non-illustrated valve means to regulate the flow of pressurized fluid from the source or sources 12 to the casting passage 4a,4b. Since the fluid is in the form of a gas or in the form of a liquid which vaporizes upon entering the casting passage 4a,4b, the fluid flows upwards from the apertures 14 into and along the upstream section 4a.

The molten metal adjacent to the side walls 2a and non-illustrated end walls of the upstream section 4a solidifies to form a thin shell, and the fluid travels through the upstream section 4a in the region between the walls and the shell. The fluid escapes from the casting passage 4a,4b by bubbling through the molten metal which is present at the meniscus level. Since, as indicated previously, the fluid has relatively low thermal conductivity, the fluid decreases the heat transfer between the shell and the walls of the upstream section 4a. This reduces the rate of growth, as well as the rate of temperature drop, of the shell so that the strand remains relatively pliable throughout the upstream section 4a.

The rate of introduction of the pressurized fluid into the mold 1g is a function of the casting parameters and can be readily determined experimentally. The rate should not be unduly great since heat transfer may then be reduced to such an extent that the shell remains too thin and too hot to carry the withdrawal stress. However, the rate should be sufficient to prevent growth of the shell to a point where the resistance to deformation becomes excessive.

Continuous casting molds are conventionally tapered in order to compensate for the shrinkage which occurs as the molten metal teemed into the mold undergoes solidification. The mold of the invention may likewise be designed to take shrinkage into account and, if this is the case, the circumference of the casting passage will not be absolutely constant. However, since the change in circumference due to shrinkage is small as compared to the circumference of the casting passage, the circumference of the casting passage may be considered as approximately constant.

The rate of change of the cross-sectional area of the casting passage may be selected in dependence upon the high-temperature mechanical properties, especially the high-temperature yield strength, of the metal to be cast. Thus, for example, the rate of change might be smaller for a metal having high yield strength than for a metal having low yield strength.

The rate of change of the cross-sectional area of the casting passage may also vary with position along the casting passage. This may be desirable in order to take into account the increasing strength of the shell with increasing distance from the inlet end of the mold. When the rate of change varies along the casting passage, such rate will be greater at locations near than at locations more remote from the inlet end. The rate of change may decrease stepwise or continuously with increasing distance from the inlet end.

The rate of change of cross-sectional area for particular casting parameters may be readily determined by routine experimentation.

The overall change in the cross-sectional area of a mold according to the invention is at least 3 percent beyond the change, if any, compensating for shrinkage. The overall change is preferably at least 15 percent and, particularly advantageously, at least 25 percent, beyond the change compensating for shrinkage.

The length of a mold according to the invention, that is, the distance between the inlet and outlet ends, may be the same as for conventional molds and will generally lie in the range of 12 to 60 inches. Preferably, the length of the mold is between 20 and 36 inches.

It is to be understood that the molds 1d,1e,1f may be designed similarly to the mold 1 in which the cross-sectional area of the casting passage decreases all the way from the inlet end to the outlet end or similarly to the molds 1a,1b,1c in which the casting passages include a section of variable cross-sectional area and one or more sections of constant cross-sectional area. Furthermore, the molds 1*d*, 1*e*, 1*f* may be provided with apertures like the apertures 14 of the mold 1*g* for the introduction of a pressurized fluid between the mold walls and the shell of the strand.

The invention is applicable to tube molds as well as plate molds. Moreover, the invention may be used for curved molds; straight molds; molds for vertical continuous casting machines; molds for inclined continuous casting machines; and molds for horizontal continuous casting machines.

Without further analysis, the foregoing will so fully reveal the gist of the present invention that others can, by applying current knowledge, readily adapt it for various applications that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A continuous casting method, comprising the steps of continuously admitting a stream of molten metal into a casting passage; partially solidifying said molten metal in said casting passage to form a continuously cast strand; continuously drawing said strand through said casting passage; reducing the cross-sectional area of said strand between upstream and downstream locations of said casting passage by an amount exceeding the reduction in cross-sectional area due to shrinkage; and decreasing the perimeter of said strand during the reducing step by an amount substantially equalling the reduction in perimeter due to shrinkage.

2. The method of claim 1, wherein the reducing step comprises progressively reducing the cross-sectional area of said strand.

3. The method of claim 1, said casting passage having an outlet opening; and wherein the reducing and decreasing maintaining steps are performed from said upstream location to said outlet opening.

4. The method of claim 1, said casting passage having an outlet opening downstream of said downstream location; and wherein the reducing step is performed in such a manner that said strand has a sheet-like configuration at said outlet opening.

5. The method of claim 1, said casting passage being generally vertical, and the admitting and drawing steps being performed in such a manner that molten metal is present in said casting passage to a predetermined level; and wherein the reducing and maintaining steps are initiated in the region of said predetermined level.

6. The method of claim 1, said casting passage having an outlet opening downstream of said downstream location; and further comprising the step of maintaining the cross-sectional area of said strand substantially constant between said downstream location and said outlet opening.

7. The method of claim 1, wherein the solidifying step is initiated at a predetermined location of said casting passage; and further comprising the step of introducing a fluid of low thermal conductivity into said casting passage downstream of said predetermined location.

8. The method of claim 7, said casting passage having an outlet opening downstream of said downstream location; and wherein the introducing step is performed in the region of said downstream location.

9. The method of claim 7, wherein said fluid comprises a gas.

10. The method of claim 9, wherein said gas is a noble gas heavier than helium.

11. The method of claim 10, wherein said gas is argon.

12. The method of claim 1, wherein the reducing step comprises changing the cross-sectional area of said strand at a rate which is a function of at least one mechanical property thereof.

13. The method of claim 12, wherein the reducing step comprises changing the cross-sectional area of said strand at a rate which is a function of the yield strength.

14. The method of claim 1, wherein the reducing step comprises changing the cross-sectional area of said strand at a first rate in the region of said upstream location, and at a second rate in the region of said downstream location.

15. The method of claim 14, wherein said first rate exceeds said second rate.

16. The method of claim 15, wherein the reducing step is performed in such a manner that said first rate is reduced to said second rate stepwise.

17. The method of claim 15, wherein the reducing step is performed in such a manner that said first rate is reduced to said second rate continuously.

18. The method of claim 1, wherein the reducing step is performed in such a manner that the cross-sectional area of said strand decreases by at least 3 percent plus the percentage due to shrinkage between said upstream and downstream locations.

19. The method of claim 18, wherein the reducing step is performed in such a manner that the cross-sectional area of said strand decreases by at least 15 percent plus the pecentage due to shrinkage between said upstream and downstream locations.

20. The method of claim 19, wherein the reducing step is performed in such a manner that the cross-sectional area of said strand decreases by at least 25 percent plus the percentage due to shrinkage between said upstream and downstream locations.

* * * * *